US008573959B2

(12) United States Patent
Syba et al.

(10) Patent No.: US 8,573,959 B2
(45) Date of Patent: Nov. 5, 2013

(54) ROTARY SPINNING ELECTRODE

(75) Inventors: Frantisek Syba, Liberec (CZ); Miroslav Maly, Visnova (CZ)

(73) Assignee: Elmarco S.R.O. (CZ)

( * ) Notice: Subject to any disclaimer, the term of this patent is extended or adjusted under 35 U.S.C. 154(b) by 44 days.

(21) Appl. No.: 13/387,418

(22) PCT Filed: Jul. 28, 2010

(86) PCT No.: PCT/CZ2010/000086

§ 371 (c)(1),
(2), (4) Date: Apr. 4, 2012

(87) PCT Pub. No.: WO2011/015161

PCT Pub. Date: Feb. 10, 2011

(65) Prior Publication Data

US 2012/0183638 A1 Jul. 19, 2012

(30) Foreign Application Priority Data

Aug. 6, 2009 (CZ) ..... PV 2009-525

(51) Int. Cl.
*B03C 7/06* (2006.01)

(52) U.S. Cl.
USPC ..... 425/174.8 E; 425/174.8 R; 425/8; 425/378.2; 425/382.2

(58) Field of Classification Search
USPC ..... 425/174.8 R, 174.8 E, 8, 378.2, 382.2
See application file for complete search history.

(56) References Cited

U.S. PATENT DOCUMENTS 4,287,139 A 9/1981 Guignard

FOREIGN PATENT DOCUMENTS

| | | | |
|---|---|---|---|
| DE | 101 36 255 | A1 | 2/2003 |
| WO | WO 2005/024101 | A1 | 3/2005 |
| WO | WO 2006/131081 | A1 | 12/2006 |
| WO | WO 2008/028428 | A1 | 3/2008 |

OTHER PUBLICATIONS

International Search Report dated Feb. 3, 2011, issued in corresponding international application No. PCT/CZ2010/000086.
Written Opinion of the International Searching Authority dated Feb. 3, 2011, issued in corresponding international application No. PCT/CZ2010/000086.

*Primary Examiner* — Joseph S Del Sole
*Assistant Examiner* — Lawrence D Hohenbrink, Jr.
(74) *Attorney, Agent, or Firm* — Ostrolenk Faber LLP

(57) ABSTRACT

The rotary spinning electrode of elongated shape, serving to carry polymer solution from reservoir of polymer solution or melt into electric field for spinning in devices for production of nanofibers through electrostatic spinning of polymer solutions or melts, including a pair of end faces (2, 3), which are arranged on the carrying mean (1), and between which are mounted the spinning members (41, 42, 43, 44, 45, 46), which are formed of a cord or wire (4). The spinning members (41, 42, 43, 44, 45, 46) are in a skew position to an axis (11) of rotation of the rotary spinning electrode.

8 Claims, 2 Drawing Sheets

ROTARY SPINNING ELECTRODE

CROSS REFERENCE TO RELATED APPLICATIONS

The present application is a 35 U.S.C. §371 National Phase conversion of PCT/EP2010/000086, filed Jul. 28, 2010, which claims benefit of Czech Republic Application No. PV 2009-525, filed Aug. 6, 2009, the disclosure of which is incorporated herein by reference. The PCT International Application was published in the English language.

TECHNICAL FIELD

The invention relates to a rotary spinning electrode of elongated shape, serving to carry the solution or melt of polymer matrix from a reservoir into an electric field for spinning in devices for production of nanofibres through electrostatic spinning of solutions or melts of polymer matrixes, comprising a pair of end faces, which are arranged on a carrying mean, and between which spinning cords or wires are mounted.

BACKGROUND OF THE INVENTION

To date known devices for production of nanofibres from polymer solution through electrostatic spinning, which comprise rotatably mounted spinning electrode of elongated shape, are for example disclosed in WO 2005/024101 A1. The device comprises the spinning electrode in the shape of a cylinder, which rotates around its main axis and by lower section of its surface it soaks into the polymer solution. The polymer solution is by a surface of the cylinder carried into the electric field between the spinning and the collecting electrode, where are created nanofibres, which are carried towards the collecting electrode and in front of it they deposit on a substrate material. This device is very well capable of production of nanofibres from water polymer solutions, nevertheless the layer of nanofibres applied on the substrate material is not uniformly spread along the whole length of the spinning electrode.

DE 101 36 255 B4 discloses a device for production of fibres from polymer solution or polymer melt, which comprises at least two spinning electrode mechanisms, each of them formed by a system of parallel wires mounted on pair of continuous belts embraced around two guiding cylinders, which are positioned one above another, while the lower guiding cylinder extends into the polymer solution or polymer melt. Between these two spinning electrode mechanisms a textile is passed as a counter electrode, while the spinning electrode mechanisms simultaneously create coating both on face side as well as backside of the textile.

The spinning electrode is together with the counter electrode, which is formed by an electrically conductive circulating belt, connected to a source of high voltage. Polymer solution or polymer melt is carried by means of wires into electric field between the spinning electrode and the counter electrode, where from the polymer solution or polymer melt are produced fibres, which are carried towards the counter electrode and land on the textile positioned on the counter electrode. A long time of staying of polymer solution or polymer melt in the electric field represents a disadvantage, because the polymer solution as well as the polymer melt are subject to ageing quite quickly, and changes its properties during the spinning process, which results also in changes of parameters of produced fibres, especially of their diameter. Another disadvantage is mounting of wires of the spinning electrode on a pair of endless belts, which are either electrically conducting and influence the electric field created between the spinning electrode and the counter electrode very negatively, or they are electrically non-conducting and high voltage is supplied to wires of spinning electrodes, in preference to one up to three wires, by means of sliding contacts, which makes the spinning device uselessly complicated.

WO 2008/028428 discloses a rotary spinning electrode of elongated shape for device for production of nanofibres through electrostatic spinning of polymer solutions, which comprises a pair of end faces between which there are mounted spinning members formed by wire, which are distributed evenly around the circumference and parallel with axis of rotation of the rotary spinning electrode. The end faces are made of electrically non-conducting material and all the spinning members are mutually connected in electrically conductive manner.

Though the spinning members mounted parallel with axis of rotation of the rotary spinning electrode ensure good conditions for spinning in electric field, nevertheless upon their exit from solution or melt of polymer, the polymer solution or polymer melt is splashed, especially at lengths of electrodes above 0.5 m, due to surface tension of polymer solution or melt, because the whole length of the spinning member emerges above the solution level in one moment.

The goal of the invention is to preserve good conditions for spinning and to eliminate the splashing upon exiting the spinning member from solution or melt of polymer.

SUMMARY OF THE INVENTION

The goal of the invention has been achieved through a rotary spinning electrode according to the invention, whose principle consists in that, spinning cords or wires are in a skew position to axis of rotation of the rotary spinning electrode. Due to the skew position, the spinning cord or wire emerges from the solution or the melt of polymer matrix gradually, so that no splashing occurs even at lengths of the spinning electrode over 1 m.

To achieve optimum conditions during spinning, it is advantageous, if the ends of the spinning cords or wires are on both end faces mounted in the same distance from the axis of rotation.

To achieve an easy supply of electric voltage onto the spinning cords or wires it is advantageous, if the end faces are made of conductive material. At this solution it is sufficient, if the electric voltage is supplied into the solution or the melt of polymer matrix and due to conductivity of end faces, whose part is still in the solution or the melt of polymer matrix, are all the spinning cords or wires under voltage.

Especially at lengths of rotary spinning electrode greater than 1 m, it is important to all spinning cords or wires to be perfectly tight. This is achieved by stretching means.

In the embodiment according to the claim 4 the spinning cords or wires of rotary spinning electrode are formed of one continual cord or one continual wire, while at least one end face is adjustable in direction of axis of rotation of the rotary spinning electrode and is coupled with the stretching mean.

The stretching mean is formed of a stopper fastened between the end faces and a pressure spring arranged between the stopper and the adjustable end face.

In an advantageous embodiment the stopper has a shape and size of the end face and it is provided with openings for passage of the spinning cords or wires to the adjustable end face on which they are fastened.

In the embodiment according to the claim 7 the spinning cords or wires are mounted independently on the end faces, and to each spinning cord or wire, there is assigned at least one individual stretching mean.

In the same time, the individual stretching mean is with advantage formed of a pressure spring arranged between the corresponding end face and an end member fastened at the end of the spinning cord or wire.

BRIEF DESCRIPTION OF THE DRAWINGS

Rotary spinning electrode according to the invention is schematically represented in the enclosed drawing, where the FIG. 1 represents an axonometric view on the rotary spinning electrode.

DESCRIPTION OF PREFERRED EMBODIMENTS

Figure 1:
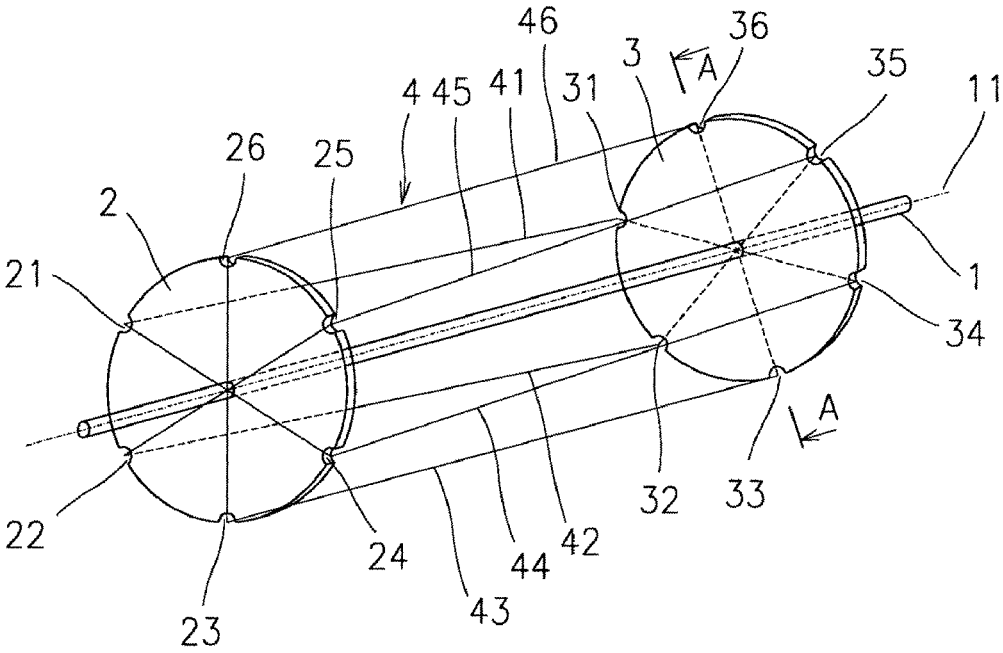

Rotary spinning electrode comprises carrying mean 1, which is in the represented embodiment formed of a shaft, on which are, perpendicular to its longitudinal axis 11, which is at the same time axis of rotation of the rotary spinning electrode, mounted end faces 2, 3. The carrying mean 1 may be formed for example of a tube or other suitable body. In example of embodiment according to the FIG. 1 both end faces 2, 3 are of the same diameter and along their circumferences there are evenly created grooves 21, 22, 23, 24, 25, 26; 31, 32, 33, 34, 35 and 36, in which a cord or wire 4 is mounted, while the sections of the cord or wire 4 tight between the end faces 2, 3 form spinning members 41, 42, 43, 44, 45, 46. The end face 3 is turned towards the end face 2, so that the spinning members 41, 42, 43, 44, 45, 46 are skew to the axis 11 of rotation of the spinning electrode. Ends of the spinning members 41, 42, 43, 44, 45, 46 are on both end faces 2, 3 mounted in the same distance from the axis of rotation. The end faces 2, 3 are made of conductive material. In example of embodiment according to the FIGS. 1 and 2 the spinning members 41, 42, 43, 44, 45, 46 are formed of one continual cord or wire 4. According to the FIG. 1 the cord or wire 4 is fastened on the fixed end faces 2, 3.

Figure 2:
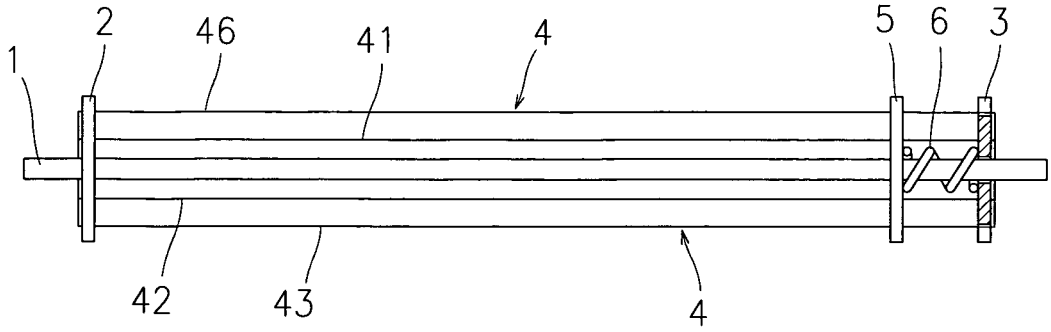
FIG. 2 shows an embodiment with stretching members formed of one cord or wire with stretching means.

According to the FIG. 2, one end face 2 is fixed and the second end face 3 is mounted axially adjustable on the carrying member 1. Between the end faces 2, 3 there is on the carrying mean 1 mounted in a fixed manner a stopper 5, between which and the adjustable end face 3 there is mounted the pressure spring 6. In the represented embodiment the stopper 5 is of the same shape and size as the end face 3 and is provided with openings or grooves for passage of the cord or wire 4 forming the spinning members 41, 42, 43, 44, 45, 46.

Figure 3:
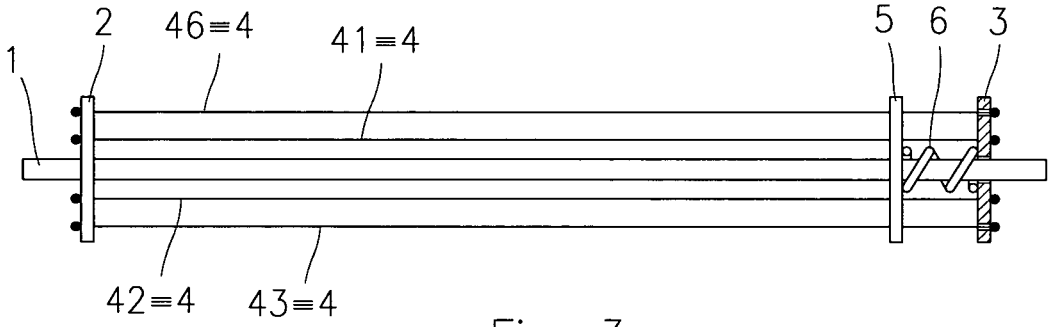
FIG. 3 shows an embodiment with independent stretching members and central stretching means.
Figure 4:
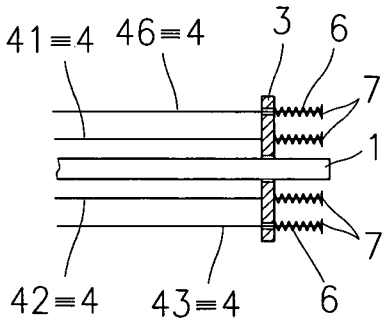
FIG. 4 shows an embodiment with independent stretching members and individual stretching means.

In example of embodiment according to the FIGS. 3 and 4, the spinning members 41, 42, 43, 44, 45, 46 are formed of individual cords or wires 4. At the FIG. 3 is in the same manner as in the embodiment according to the FIG. 2 one end face 2 fixed and the second end face 3 mounted axially adjustable on the carrying member 1. Between the end faces 2, 3 there is on the carrying mean 1 in a fixed manner mounted the stopper 5, between which and the adjustable end face 3 there is mounted the pressure spring 6. At the represented embodiment the stopper 5 is of the same shape and size as the end face 3 and is provided with openings or grooves for passage of cords or wires 4 forming the spinning members 41, 42, 43, 44, 45, 46. In a not represented embodiment the diameter of the stopper 5 is smaller than the diameter of the end face 3. In this embodiment, all individual spinning members 41, 42, 43, 44, 45, 46 are stretched by one adjustable end face 3 and the pressure spring 6, which imposes great demand on very identical length of individual spinning members 41, 42, 43, 44, 45, 46.

This problem is remedied by arrangement according to the FIG. 4, where individual stretching mean, which is formed of a pressure spring 6 and the end member 7 fastened at the end of the spinning member 41, 42, 43, 44, 45, 46 is assigned to each individual spinning member 41, 42, 43, 44, 45, 46.

If there is a need to change the length of rotary spinning electrode, the end faces 2, 3 on the carrying mean 1 may be adjusted in a simple way. For example, the carrying member 1 may be provided with fastening openings of constant spacing. Then, the user has possibility to adjust the distance of end faces 2, 3 according to the width of material being processed.

LIST OF REFERENTIAL MARKINGS

1 carrying mean
11 axis
2 end face
21, 22, 23, 24, 25, 26 grooves
3 end face
31, 32, 33, 34, 35, 36 grooves
4 cord or wire
41, 42, 43, 44, 45, 46 spinning member
5 stopper
6 pressure spring
7 end member

What is claimed is:

1. A rotary spinning electrode of elongated shape serving to carry the polymer solution from reservoir of polymer solution or melt into electric field for spinning in devices for production of nanofibres through electrostatic spinning of polymer solutions or melts, comprising a pair of end faces, which are arranged on the carrying mean, and between which are mounted spinning members, which are formed of a cord or wire, wherein the spinning members are in a skew position to an axis of rotation of the rotary spinning electrode.

2. The rotary spinning electrode according to claim 1, wherein the ends of the spinning members are on both end faces mounted in the same distance from the axis of rotation.

3. The rotary spinning electrode according to claim 2, wherein the end faces are made of a conductive material.

4. The rotary spinning electrode according to claim 1, wherein the spinning members are formed of one continual cord or one continual wire, while at least one end face is adjustable in direction of axis of rotation of the rotary spinning electrode and is coupled with a stretching mean.

5. The rotary spinning electrode according to claim 4, wherein the stretching mean is formed of a stopper fastened between the end faces and of a pressure spring arranged between the stopper and the adjustable end face.

6. The rotary spinning electrode according to claim 5, wherein the stopper has shape and size of end faces and is provided with openings for passage of the spinning members to the adjustable end face on which the spinning members are fastened.

7. The rotary spinning electrode according to claim 1, wherein the spinning members are on the end faces mounted independently and to each of them is assigned at least one individual stretching means.

8. The rotary spinning electrode according to claim 7, wherein the individual stretching mean is formed of a pressure spring arranged between the respective end face and an end member fastened at an end of the spinning member.

* * * * *

UNITED STATES PATENT AND TRADEMARK OFFICE

CERTIFICATE OF CORRECTION

PATENT NO. : 8,573,959 B2
APPLICATION NO. : 13/387418
DATED : November 5, 2013
INVENTOR(S) : Syba et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 103 days.

Signed and Sealed this
Twenty-second Day of September, 2015

Michelle K. Lee

Michelle K. Lee
*Director of the United States Patent and Trademark Office*